US011272797B1

(12) United States Patent
Ganushchak

(10) Patent No.: US 11,272,797 B1
(45) Date of Patent: Mar. 15, 2022

(54) MULTI-PILLOWCASE ASSEMBLY

(71) Applicant: Roman Ganushchak, Maplewood, MN (US)

(72) Inventor: Roman Ganushchak, Maplewood, MN (US)

( * ) Notice: Subject to any disclaimer, the term of this patent is extended or adjusted under 35 U.S.C. 154(b) by 63 days.

(21) Appl. No.: 16/883,684

(22) Filed: May 26, 2020

Related U.S. Application Data

(60) Provisional application No. 62/853,095, filed on May 27, 2019.

(51) Int. Cl.
*A47G 9/02* (2006.01)
*A47G 9/04* (2006.01)

(52) U.S. Cl.
CPC ..... *A47G 9/0253* (2013.01); *A47G 9/04* (2013.01)

(58) Field of Classification Search
CPC ..... A47G 9/0253; A47G 9/04
See application file for complete search history.

(56) References Cited

U.S. PATENT DOCUMENTS 1,284,459 A * 11/1918 Ross ..... A47G 9/0253 5/490
1,542,561 A * 6/1925 Laskin ..... A47G 9/0253 5/484
3,044,517 A * 7/1962 Daisy ..... A47C 27/002 150/158
3,109,474 A * 11/1963 Daisy ..... A47G 9/0253 150/158
3,974,531 A * 8/1976 Van Pelt ..... A47G 9/0253 5/490
5,557,815 A * 9/1996 Mintz ..... A47C 27/00 297/223
5,652,983 A * 8/1997 Kraemer ..... A47G 9/0253 5/630
2005/0177941 A1* 8/2005 Miller ..... A47G 9/0253 5/490
2012/0186016 A1* 7/2012 Martin ..... A47G 9/0253 5/490
2014/0000036 A1* 1/2014 Cohen ..... A47C 27/081 5/639
2016/0309928 A1* 10/2016 Lukin, Jr. ..... A47G 9/0253
2017/0105555 A1* 4/2017 Lukin, Jr. ..... A47G 9/0253

* cited by examiner

*Primary Examiner* — Eric J Kurilla
(74) *Attorney, Agent, or Firm* — Johnson and Phung LLC; Thomas N. Phung

(57) ABSTRACT

A multi-pillowcase assembly that includes a pillow having a first end and a second end, a set of at least 2 pillowcases each having a first end, a second end, a first side, a second side, a pillowcase displaying condition and a pillowcase inside-out condition, the pillowcases each having an opening for converting the pillowcases between the pillowcase displaying condition and the pillowcase inside-out condition and a fastener attaching the first end of the pillow to the first end of the pillowcase in the pillowcase back side condition.

20 Claims, 4 Drawing Sheets

MULTI-PILLOWCASE ASSEMBLY

FIELD OF INVENTION

The present invention relates to bedding, and more specifically, to a multi-decorative pillowcase assembly that includes a set of pillowcases that are attachable to various types of pillows to allow users to change different designs to the pillow.

CROSS REFERENCE TO RELATED APPLICATIONS

This application claims priority to currently U.S. Provisional Application Ser. No. 62/853,095; filed on May 27, 2019; titled MULTI-PILLOWCASE ASSEMBLY.

STATEMENT REGARDING FEDERALLY SPONSORED RESEARCH OR DEVELOPMENT

None

BACKGROUND OF THE INVENTION

Pillowcases for covering various type of pillows such as decorative pillows and sleeping pillows are well known in the art and are used by almost every culture. By their very nature pillowcases are changed on a regular basis, whether it's to replace a used pillowcase with a fresh pillowcase or to replace a pillowcase having a specific themed design with another pillowcase having a different themed design.

The present invention is an improvement in the field of pillowcases by providing a multi-decorative pillowcase assembly that includes a set of pillowcases that are attached to various types of pillows to allow the user to change different designs to the pillow from the set of pillowcases.

SUMMARY OF THE INVENTION

Briefly, the present invention comprises a multi-pillowcase assembly that includes a pillow having a first end and a second end, a set of at least 2 pillowcases each having a first end, a second end, a first side, a second side, a pillowcase displaying condition and a pillowcase inside-out condition. The pillowcases each includes an opening for converting the pillowcases between the pillowcase displaying condition and the pillowcase inside-out condition and a fastener attaching the first end of the pillow to the first end of the pillowcases in the pillowcase back side condition.

The pillowcases may either be permanently secured to the pillow or removably secured to the pillow by different types of removeable fastener such as a binder ring fastening system having at least one binder ring, a hook and loop fastening system, a locking pin, and a button-based fastening system.

The pillowcases may also include a closure fastening system located proximal the opening of each of the pillowcase to assist in maintaining the pillow within the pillowcase such as a hook and loop fastening system, a button closure fastening system, and a zipper closure fastening system.

The present invention may also comprise a multi-pillowcase assembly that includes a pillow having a first end and a second end, a set of at least 2 pillowcases each having a first end, a second end, a first side, a second side, a pillowcase displaying condition and a pillowcase inside-out condition. The pillowcases each includes an opening for converting the pillowcases between the pillowcase displaying condition and the pillowcase inside-out condition. Supported on the pillowcase displaying condition of each pillowcase is a design. The pillowcase may also include a button-based fastening system attaching the first end of the pillow to the first end of the pillowcase in the pillowcase displaying condition with the button-based fastening system having at least one button located proximal the first end of the pillow and at least one corresponding buttonhole located proximal the first end of each of the pillowcases in the inside-out condition with the button matingly engageable with the buttonholes to removably secure the pillowcases to the pillow. The pillowcases each may also include a closure fastening system located proximal the opening of each of the pillowcase to assist in maintaining the pillow within the pillowcase.

DESCRIPTION OF THE PREFERRED EMBODIMENT

Figure 1:
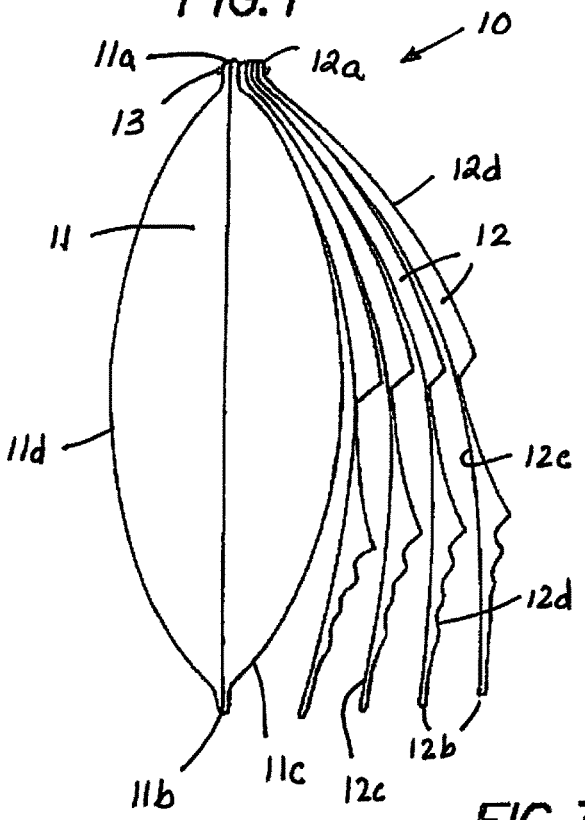
FIG. 1 is a side view showing an embodiment of a multi-decorative pillowcase assembly of the present invention.

The general purpose of the present invention, which will be described subsequently in greater detail, is to provide a multi-decorative pillowcase assembly that attaches to various type of pillows to allow the user to change different designs to the pillow without having to change the pillowcase assembly.

There has thus been outlined the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the disclosing subject matter be regarded as including such equivalent constructions insofar as they do not depart from the spirit and scope of the present invention.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

In addition, the accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of any potential claims.

FIG. 1 is a side view showing an embodiment of a multi-decorative pillowcase assembly 10 of the present invention, which generally comprises a pillow 11 having a first end 11*a*, a second end 11*b*, a first side 11*c*, a second side 11*d* and a set of 4 decorative pillowcases 12 each having a first end 12*a*, a second end 12*b*, a first side 12*c*, and a second side 12*d*. It is noted that the pillow 11 may comprise but is not limited to a euro pillow, a boudoir pillow, a neckroll pillow, or a sleeping pillow and the decorative pillowcases 12 may correspondingly comprise a euro pillowcase, a boudoir pillowcase, a neckroll pillowcase, or a sleeping pillowcase.

The decorative pillowcases 12 are all shown in a pillowcase inside-out condition, meaning that an interior of the decorative pillowcases, normally with the seams shown, are exposed, with the first end 12*a* of the pillowcases 12 attached to the first end 11*a* of the pillow 11 through the use of a fastener such as locking pin 13.

Although the embodiment of FIG. 1 shows the fastener as comprising locking pin 13, it is noted that alternative embodiments of the present invention may include a fastener comprising but not limited to an adhesive, a threaded stitching, and various types of removeable fasteners including binder ring(s), binder spine, a hook and loop fastening system, a rivet based fastening system, a zipper fastening system, and a button-based fastening system.

Each of the pillowcases 12 also include an opening 13 for converting each of the pillowcases 12 between a pillowcase displaying condition and the pillowcase inside-out condition. The pillowcase displaying condition is defined as the condition in which the pillowcase 12 is in use and supporting pillow 11 within an envelope formed by the pillowcase 12. In the pillowcase displaying condition, at least one surface of each of the pillowcases 12 supports a design 14 thereon. The aforementioned design may comprise but is not limited to a solid color, a color scheme, a printed or stitched-on design. The design supported on the pillowcases may comprise the same for all of the pillowcases 12 in the set or preferably, a different design for each pillowcase 12 in the set. The design may comprise seasonal colors, printed designs that relates to or identifies each season such as flowers for spring, beaches or picnics for summer, colored leaves for fall, and snow for winter. The design supported on the pillowcases may also be holiday themed such as, for example, fireworks for The Fourth of July, Pumpkin Lanterns for Halloweens, Turkey Dinner for Thanksgiving, a Christmas tree for Christmas, and colored eggs for Easter.

FIGS. 2-6 are all side views showing the conversion of one of the pillowcases 12 of the multi-decorative pillowcase assembly 10 of FIG. 1 from the pillowcase inside-out condition to the pillowcase displaying condition. The aforementioned is done to either provide for a new or clean pillowcase 12 for pillow 11 or to provided pillow 11 with a new themed design.

Figure 2:
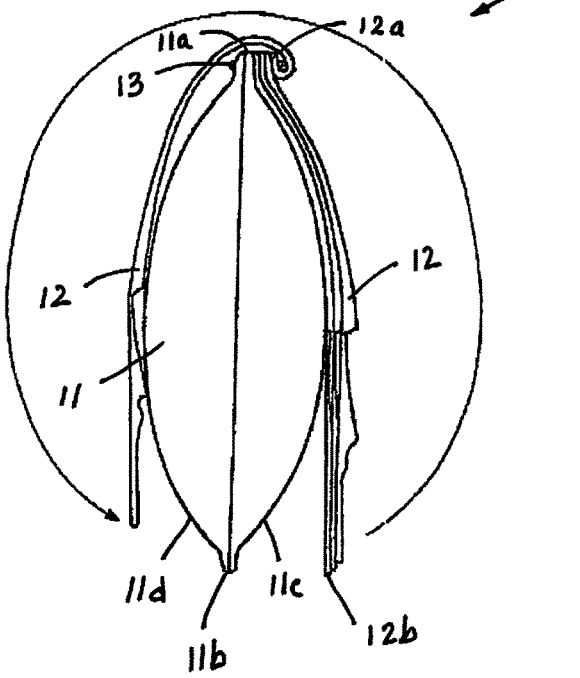
FIG. 2 is a side view showing one of the pillowcases of a set of pillowcases flipped over to a second side of a pillow while the remaining pillowcases are located on a first side the pillow.

Referring to FIG. 2, FIG. 2 shows the first end 12*a* of each of the pillowcases 12 attached proximal to the first end 11*a* on the first side 11*c* of the pillow 11 through the use of a fastener such as locking pin 13 with one of the decorative pillowcases 12 flipped over to the second side 11*d* of the pillow 11 while the remaining pillowcases 12 are located proximal the first side of pillow 11.

Figure 3:
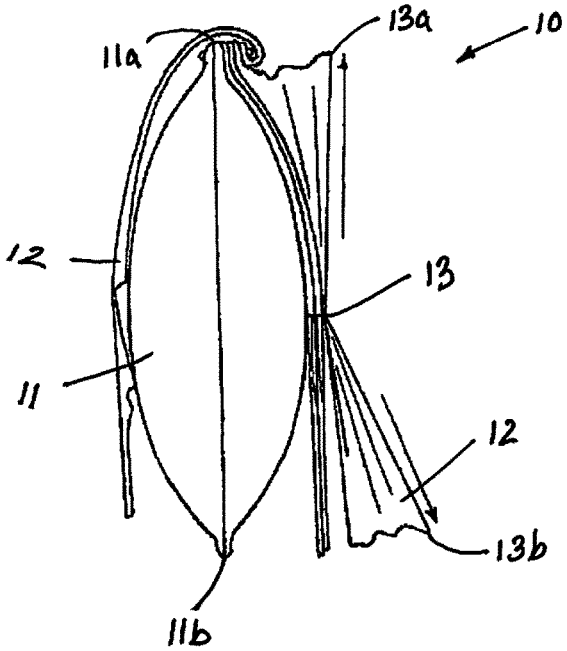
FIG. 3 is a side view showing a first flap and a second flap of an opening of the pillowcase of FIG. 2 being stretched in opposite directions.

FIG. 3 shows a first flap 13*a* and a second flap 13*b* of the opening of pillowcase 12 being stretched out or opened in opposite directions towards the corresponding ends 11*a* and 11*b* of pillow 11.

Figure 4:
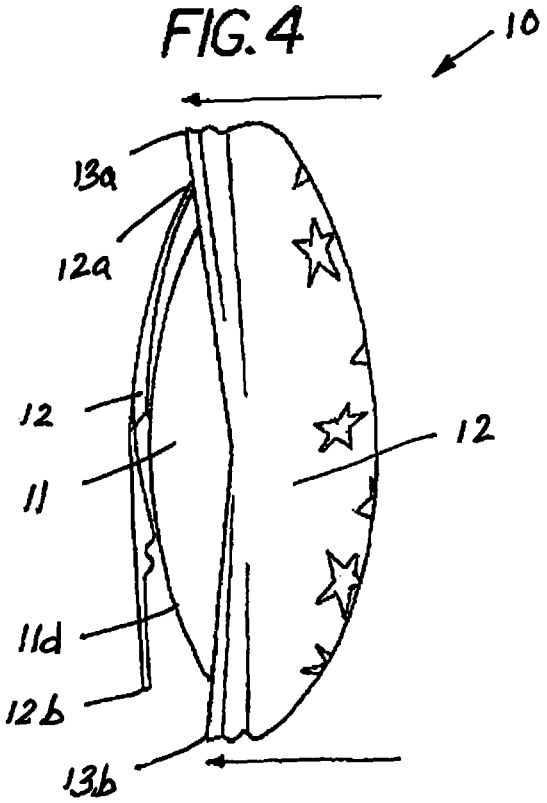
FIG. 4 shows the first and the second flaps of the pillowcase of FIG. 3 being extended over the ends of the pillow.

FIG. 4 shows the first flap 13*a* of pillowcase 12 being extended over the first end 11*a* of pillow 11 and the second flap 13*b* of pillowcase 12 being extended over the second end 11*b* of pillow 11 while also encompassing or extending over the ends 12*a* and 12*b* of the pillowcase(s) 12 that is located on the second side 11*d* of the pillow 11.

Figure 5:
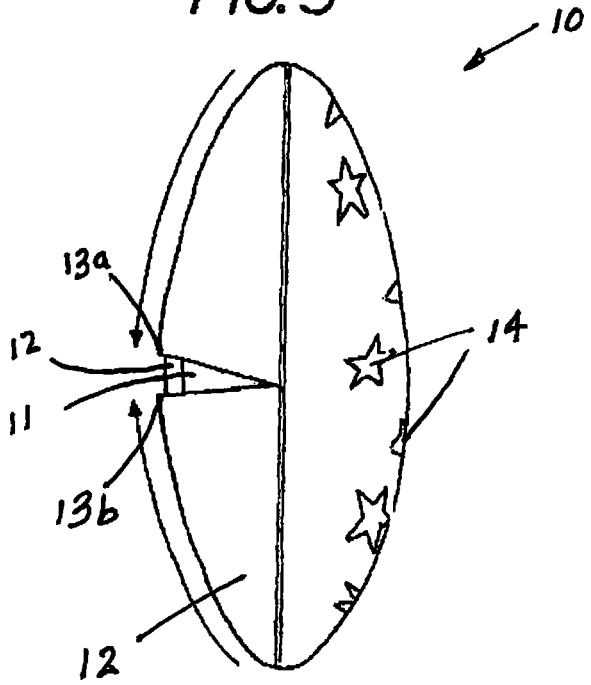
FIG. 5 shows the first and the second flaps of the pillowcase of FIG. 4 being moved closer towards each other to display of a design supported on the pillowcase.

FIG. 5 shows the first flap 13*a* and the second flap 13*b* of pillowcase 12 being moved closer towards each other to minimize the exposure of pillow 11 and any pillowcase(s) 12 located on the second side 11*d* of pillow 11 while allowing for the displaying of the design 14 supported on the pillowcase 12 in the pillowcase displaying condition.

Figure 6:
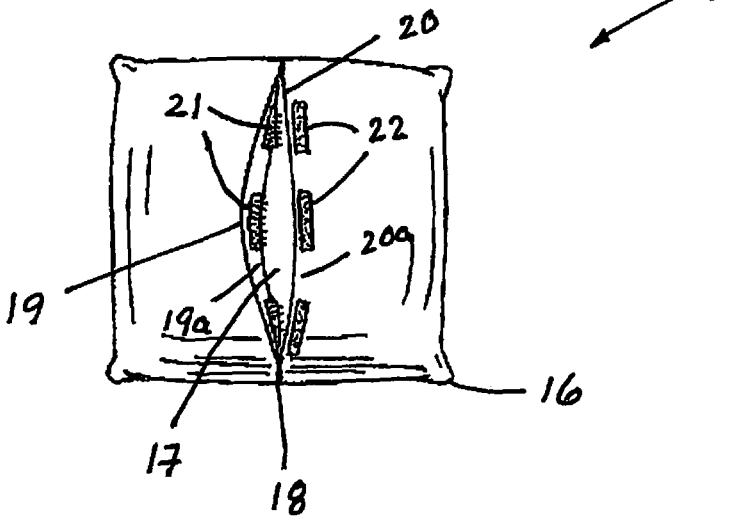
FIG. 6 is a back view showing an alternative embodiment of a multi-decorative pillowcase assembly having a pillowcase with a hook and loop fastening system.
Figure 7:
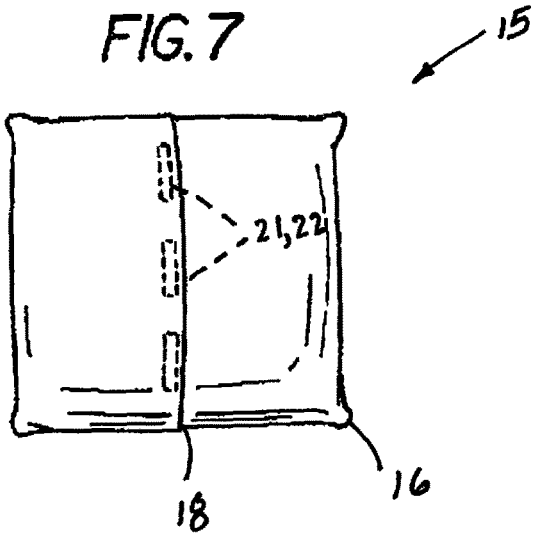
FIG. 7 shows the multi-decorative pillowcase assembly of FIG. 6 with an opening of the pillowcase in a closed condition.

Referring to FIGS. 6-7, FIG. 6 is a back view showing an alternative embodiment of a multi-decorative pillowcase assembly 15 having a decorative pillowcase 16 used on a decorative pillow 17 with an opening 18 of the pillowcase 16 exposing a portion of the decorative pillow 17. In the embodiment of FIG. 6 the pillowcase 16 includes a closure fastening system located proximal the opening 18 of the pillowcase 16 to assist in maintaining the pillow 17 within the pillowcase 16. The closure fastening system of pillowcase 16 is shown in the embodiment of FIG. 6 as comprising a hook and loop fastening system with a first flap 19 having a plurality of strips of hooks 21 attached to an underside 19*a* of the flap 19 and a second flap 20 having a plurality of corresponding strips of loops 22 attached to a topside 20*a* of flap 20.

FIG. 7 shows a back view of multi-decorative pillowcase assembly 15 but with the opening 18 in a closed condition through the securable engagement of the plurality of strips of hooks 21 with the plurality of corresponding strips of loops 22. Although the FIGS. 6 and 7 show the strips of hooks 21 attached to the underside 19*a* of first flap 19 and the strips of loops 22 attached to the topside 20*a* of flap 20, alternative embodiments of the present invention may include pillowcases having the strips of loops 22 attached to the underside 19*a* of first flap 19 and the strips of hooks 21 attached to the topside 20*a* of flap 20. In addition, alternative embodiments of the present invention may also include pillowcases having a closure fastening system comprising but not limited to a button closure fastening system, a rivet closure fastening system, or a zipper closure fastening system to assist in maintaining the pillow within the pillowcase.

Figure 8:
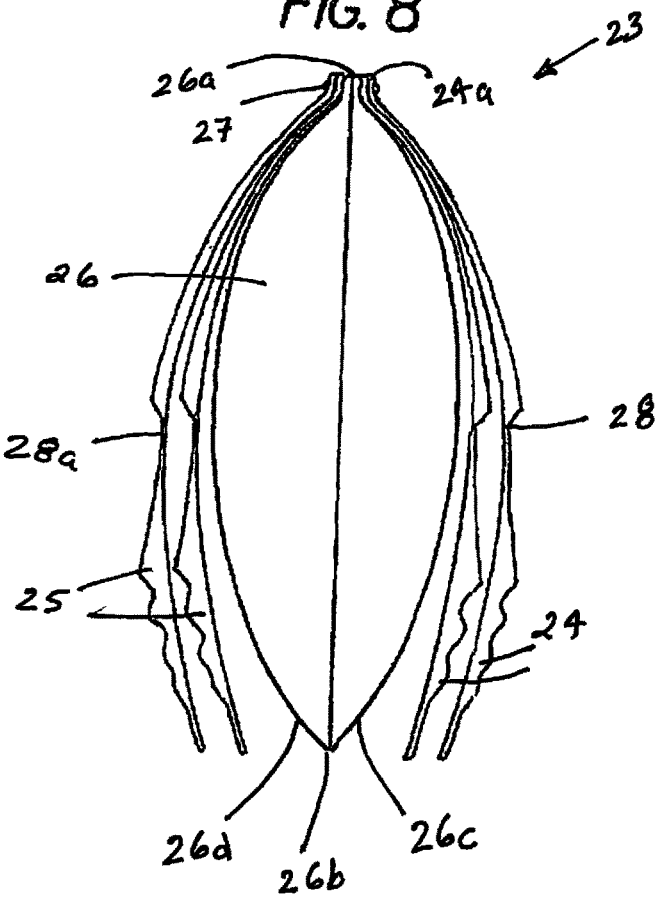
FIG. 8 is a side view showing an alternative embodiment of a multi-decorative pillowcase assembly having a set of decorative pillowcases located on each side of a pillow.

FIG. 8 is a side view showing a multi-decorative pillowcase assembly 23 similar to the multi-decorative pillowcase assembly 10 of FIG. 1. However, the multi-decorative pillowcase assembly 23 of FIG. 8 includes a first set of decorative pillowcases 24 each having a different design or print located on a first side 26*c* of a pillow 26 and a second set of decorative pillowcases 25 each having a different design or print located on a second side 26*d* of the pillow 26. Similar to the multi-decorative pillowcase assembly 10 of FIG. 1, a first end 24*a* of each of the decorative pillowcases 24 and a first end 25*a* of each of the pillowcases 25 are secured to a first end 26*a* of pillow 26 by a fastener such as a locking pin 27. It is noted that although an opening 28, 28*a* of pillowcases 24 and 25 are each shown facing away from pillow 26, alternative embodiments of the present invention may also include pillowcases with openings facing towards the pillows.

Figure 9:
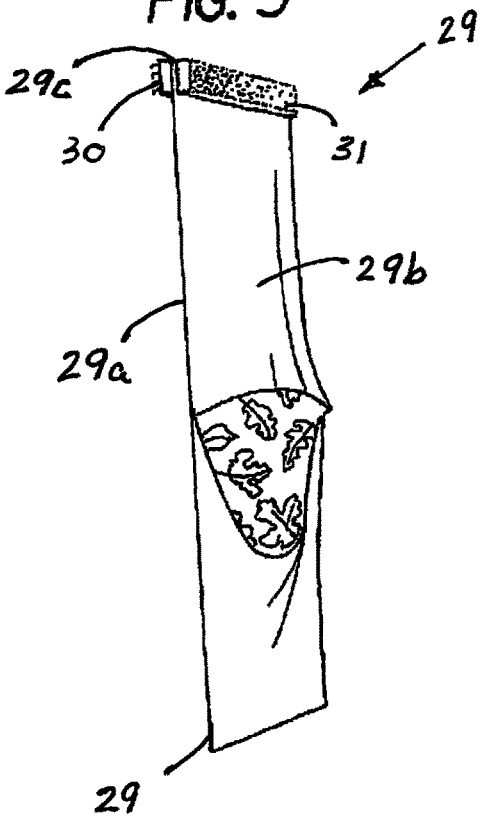
FIG. 9 is a side view showing an individual decorative pillowcase that may be removably attached to one or more similar decorative pillowcases or directly to a pillow.

FIG. 9 shows an alternative embodiment of the present invention comprising an individual decorative pillowcase 29 that may be removably attached to one or more similar decorative pillowcases 29 or directly to a pillow. The decorative pillowcase 29 is shown an inside-out condition and includes at least one strip of hooks 30 located on a first side 29*a* and proximal a first end 29*c* of the pillowcase 29 and at least one strip of loops 31 located on the second side 29*b* and proximal the first end 29*c* of the pillowcase 29.

Figure 10:
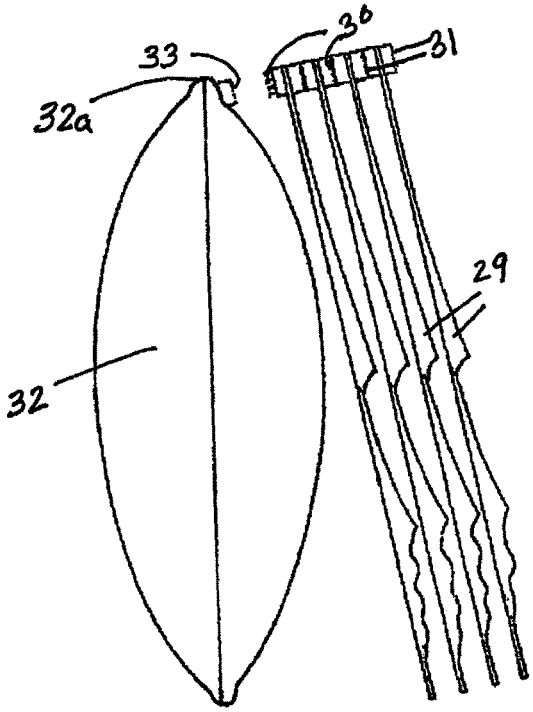
FIG. 10 is a side view showing a multi-decorative pillowcase assembly that includes a set of four decorative pillowcases of FIG. 9.

FIG. 10 is a side view showing a set of four decorative pillowcases 29 of FIG. 9 removably attached to each other with the decorative pillowcases 29 each having a different design or print. More specifically, the hook strip 30 of the decorative pillowcases 29 are shown secured to a corresponding loop strip 31 located on an adjacent decorative pillowcase 29. It is noted that the pillowcases 29 located at each end of the attached set of pillowcases 29 will either have a free or unattached hook strip 30 or a free or unattached loop strip 31 to enable the set of pillowcases 29 to secure to a pillow 32 having corresponding strip hooks or loops located proximal an end of the pillow. In the embodiment of FIG. 10 a pillow 32 is show having at least one strip of loop 33 located proximal a first end 32*a* of the pillow 32 for attaching engagement with the corresponding hook strip 30 of set of pillowcases 29. It is noted that pillow 32 may alternatively include at least one strip of hooks, not shown, located proximal the first end 32*a* of the pillow 32 for attaching engagement with the corresponding loop strip 31 of set of pillowcases 29.

Figure 11:
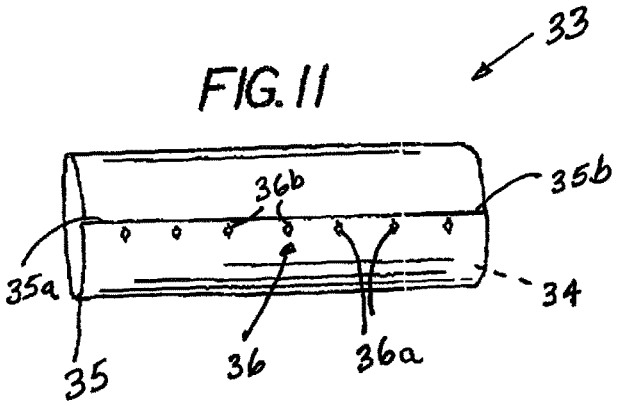
FIG. 11 is a back view showing an alternative embodiment of a multi-decorative pillowcase assembly that includes a neck pillowcase having a button-based fastening system.

FIG. 11 is a back view of an alternative embodiment of a multi-decorative pillowcase assembly 33 of the present invention comprising a neckroll pillow 34 having a decorative pillowcase 35 with a removeable fastener system comprising a button-based fastening system 36 having at least one button and preferably a plurality of buttons 36*a* located proximal a first end 35*a* of the pillowcase 35 and at least one corresponding buttonhole 36*b* located proximal a second end 35*b* of each of the pillowcases 35 with the buttons 36*a* matingly engageable with the buttonholes 36*b* to secure the pillowcase 35 to the pillow 34.

Although not shown, for irregular shaped pillows such as neckroll pillows 34 or circular shaped pillow, the decorative pillowcase 35 or set of decorative pillowcase 35 may be secured to any locations on those pillows and preferably to a crease of those pillows.

Figure 12:
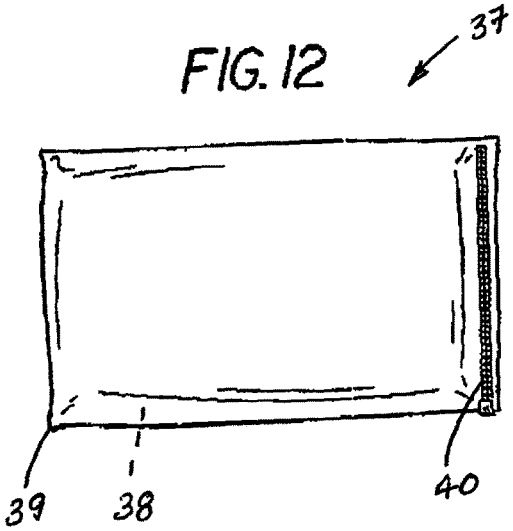
FIG. 12 is a back view showing an alternative embodiment of a multi-decorative pillowcase assembly having a decorative pillowcase with a zipper closure fastening system.

FIG. 12 is a back view of an alternative embodiment of a multi-decorative pillowcase assembly 37 of the present invention comprising a standard sleeping pillow 38 having a decorative pillowcase 39 with a closure fastening system comprises a zipper closure fastening system 40.

Figure 13:
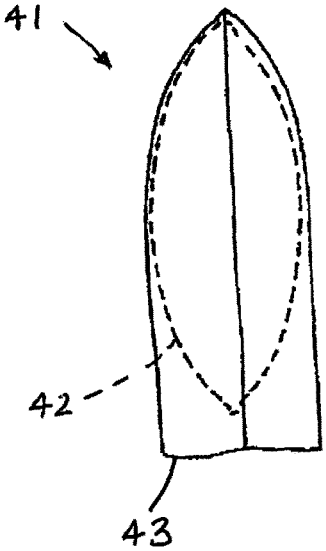
FIG. 13 is a side view showing an alternative embodiment of a multi-decorative pillowcase assembly having a decorative pillowcase with an opened end.

FIG. 13 is a side view of an alternative embodiment of a multi-decorative pillowcase assembly 41 of the present invention comprising a standard sleeping pillow 42 having a decorative pillowcase 42 with an opened end 43 covering on the standard sleeping pillow 42. It is noted that the term sleeping pillows includes the standard pillow, queen pillow, king pillow.

I claim:

1. A multi-pillowcase assembly comprising:

a pillow having a first end and a second end;

a set of at least 2 pillowcases, each pillowcase of the set of at least 2 pillowcases having a first end, a second end, a first side, a second side, a pillowcase displaying condition and a pillowcase inside-out condition, each pillowcase of the set of at least 2 pillowcases includes an opening located on one of the sides of the pillowcase with the opening having a first flap and a second flap with the flaps stretchable in opposite directions towards the corresponding ends of the pillow to encase the pillow completely within the pillowcase in the pillowcase displaying condition; and a fastener attaching the first end of each of the pillowcases in the pillowcase inside-out condition to the first end of the pillow while the second end of each of the pillowcases are unattached to the pillow or each other.

2. The multi-pillowcase assembly of claim 1 wherein each of the pillowcases comprises a different design in the pillowcase displaying condition.

3. The multi-pillowcase assembly of claim 2 wherein the pillowcases are secured to the pillow by a removeable fastener.

4. The multi-pillowcase assembly of claim 3 wherein the removeable fastener comprises a binder ring fastening system having at least one binder ring.

5. The multi-pillowcase assembly of claim 3 wherein the removeable fastener comprises a hook and loop fastening system.

6. The multi-pillowcase assembly of claim 3 wherein the removeable fastener comprises a locking pin.

7. The multi-pillowcase assembly of claim 3 wherein the removeable fastener comprises a button-based fastening system.

8. The multi-pillowcase assembly of claim 3 wherein additional pillow cases may be added or removed from the set of at least 2 pillowcases.

9. The multi-pillowcase assembly of claim 1 wherein each of the pillowcases includes a closure fastening system located proximal the opening of each of the pillowcase to assist in maintaining the pillow within the pillowcase.

10. The multi-pillowcase assembly of claim 9 wherein closure fastening system comprises a hook and loop fastening system.

11. The multi-pillowcase assembly of claim 9 wherein closure fastening system comprises a button closure fastening system.

12. The multi-pillowcase assembly of claim 9 wherein closure fastening system comprises a zipper closure fastening system.

13. The multi-pillowcase assembly of claim 1 wherein each of the pillowcases comprises a euro pillowcase, a boudoir pillowcase, a neckroll pillowcase, or a sleeping pillowcase.

14. A multi-pillowcase assembly comprising:

a pillow having a first end and a second end;

a set of at least 2 pillowcases, each pillowcase of the set of at least 2 pillowcases having a first end, a second end, a first side, a second side, a pillowcase displaying condition and a pillowcase inside-out condition, each pillowcase of the set of at least 2 pillowcases includes an opening located on one of the sides of the pillowcase with the opening having a first flap and a second flap with the flaps stretchable in opposite directions from each other towards the corresponding ends of the pillow to encase the pillow completely within the pillowcase in the pillowcase displaying condition; and a removeable fastener system attaching the first end of each of the pillowcases in the pillowcase inside-out condition to the first end of the pillow while the second end of each of the pillowcases are unattached to the pillow or each other.

15. The multi-pillowcase assembly of claim 14 wherein the removeable fastener system comprises a button-based fastening system having at least one button located proximal the first end of the pillow and at least one corresponding buttonhole located proximal the first end of each of the pillowcases, the at least one button matingly engageable with the buttonholes to removably secure the pillowcases to the pillow.

16. The multi-pillowcase assembly of claim 14 wherein the removeable fastener system comprises a binder spine fastening system having at least two binder rings.

17. The multi-pillowcase assembly of claim 14 wherein the removeable fastener system comprises a hook and loop fastening system.

18. The multi-pillowcase assembly of claim 17 wherein each of the pillowcases includes at least one strip of hooks located on the first side and proximal the first end of the pillowcase in the inside-out condition and at least one strip of loops located on the second side and proximal the first end of the pillowcase in the inside-out condition.

19. The multi-pillowcase assembly of claim 18 wherein each of the pillowcases removably attachable to each other independent of the pillow.

20. A multi-pillowcase assembly comprising:

a pillow having a first end and a second end;

a set of at least 2 pillowcases, each pillow case of said set of at least 2 pillowcases having a first end, a second end, a first side, a second side, a pillowcase displaying condition and a pillowcase inside-out condition, the pillowcases each having an opening for converting the pillowcases between the pillowcase displaying condition and the pillowcase inside-out condition;

a design supported on the pillowcase displaying condition of each pillowcase with each pillowcase supporting a different design;

a button-based fastening system attaching the first end of the pillow to the first end of the pillowcase in the pillowcase displaying condition, the button-based fastening system having at least one button located proximal the first end of the pillow and at least one corresponding buttonhole located proximal the first end of each of the pillowcases in the inside-out condition with the at least one button matingly engageable with the buttonholes to removably secure the pillowcases to the pillow; and a closure fastening system located proximal the opening of each of the pillowcase to assist in maintaining the pillow within the pillowcase.

* * * * *